US009394755B1

(12) United States Patent
DeRouen, Sr.

(10) Patent No.: US 9,394,755 B1
(45) Date of Patent: Jul. 19, 2016

(54) METHOD AND APPARATUS FOR CATCHING AND RETRIEVING OBJECTS IN A WELL

(71) Applicant: Mark W. DeRouen, Sr., Eunice, LA (US)

(72) Inventor: Mark W. DeRouen, Sr., Eunice, LA (US)

(73) Assignee: 5D I.P., L.L.C., Eunice, LA (US)

( * ) Notice: Subject to any disclaimer, the term of this patent is extended or adjusted under 35 U.S.C. 154(b) by 564 days.

(21) Appl. No.: 13/873,718

(22) Filed: Apr. 30, 2013

Related U.S. Application Data

(63) Continuation of application No. 13/553,915, filed on Jul. 20, 2012, now abandoned.

(60) Provisional application No. 61/510,229, filed on Jul. 21, 2011, provisional application No. 61/610,757, filed on Mar. 14, 2012.

(51) Int. Cl.
*E21B 31/06* (2006.01)
*B03C 1/26* (2006.01)

(52) U.S. Cl.
CPC .. *E21B 31/06* (2013.01); *B03C 1/26* (2013.01)

(58) Field of Classification Search
CPC ..... C02F 1/482; C02F 1/481; F02M 27/045; E21B 31/06; B03C 1/26; B03C 2201/18; B03C 2201/28; B03C 1/13; B03C 1/00
See application file for complete search history.

(56) References Cited

U.S. PATENT DOCUMENTS

| | | | | |
|---|---|---|---|---|
| 2,699,871 | A * | 1/1955 | Stem | 209/223.1 |
| 2,781,128 | A * | 2/1957 | Stem | 209/223.1 |
| 3,187,238 | A | 6/1965 | Wilson et al. | |
| 5,052,491 | A | 10/1991 | Harms et al. | |
| 5,944,100 | A | 8/1999 | Hipp | |

OTHER PUBLICATIONS

PCT International Search Report dated Oct. 1, 2012.

* cited by examiner

*Primary Examiner* — Blake Michener
*Assistant Examiner* — Kipp Wallace
(74) *Attorney, Agent, or Firm* — Ted M. Anthony

(57) ABSTRACT

A magnet assembly having selectively removable magnet members can be attached to, or placed in the vicinity of, a conventional bell nipple or riser on a drilling rig to generate a magnetic field within a wellbore. The magnetic field catches falling metal objects and prevents such objects from passing beyond the magnet assembly and entering subterranean portions of a wellbore. Hatch doors are provided for easy access to inner portions of the magnet assembly.

15 Claims, 11 Drawing Sheets

METHOD AND APPARATUS FOR CATCHING AND RETRIEVING OBJECTS IN A WELL

CROSS REFERENCES TO RELATED APPLICATION

This Application is a Continuation-in-Part of U.S. Non-Provisional patent application Ser. No. 13/553,915, filed Jul. 20, 2012, which claims priority of U.S. Provisional Patent Application Ser. No. 61/510,229, filed Jul. 21, 2011, and U.S. Provisional Patent Application Ser. No. 61/610,757, filed Mar. 14, 2012, all incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a method and apparatus for preventing unwanted objects from entering subterranean portions of a wellbore. More particularly, the present invention pertains to the use of magnetic field(s) to catch unwanted objects within a wellbore. More particularly still, the present invention pertains to an apparatus for generating magnetic field(s) between a rig floor of a drilling or completion rig and a wellhead, such as in or near a bell nipple or riser assembly, in order to prevent unwanted objects from entering a wellbore below said wellhead.

2. Brief Description of the Prior Art

A bell nipple is a large diameter length of pipe utilized on most drilling and completion rigs. In most cases, a bell nipple is installed at or near the top of a rig's blowout preventers and extends to a well's uppermost opening at the rig floor; the bell nipple typically serves as a "funnel" to guide drilling tools and/or other equipment into and out of the upper opening of a well. Most conventional bell nipples also serve as conduits for drilling muds and/or other fluids present within a well. As such, most conventional bell nipples are typically configured with a side outlet to permit fluid to flow from a well to a rig's surface fluid equipment such as shale shakers and mud tanks.

Unfortunately, not all objects that a bell nipple guides into a wellbore are beneficial. Objects can sometimes accidentally fall into the uppermost opening of a well from the rig floor. In other instances, objects can be purposely thrown or dropped into a well as an intentional act of sabotage. If such objects are not stopped before entering the subterranean portion of the wellbore, the objects can prevent downhole equipment from functioning properly and can often impede the drilling and/or completion process.

Relatively large objects can generally be retrieved from a wellbore using specially designed "fishing tools." Such fishing tools are lowered into a wellbore and connect to a dropped object within the wellbore. Thereafter, the fishing tools and the connected object can both be safely retrieved from the wellbore. In many instances, the retrieval process for such large objects can be relatively simple because the size of the objects enables such objects to be grasped and lifted out of the wellbore.

By contrast, relatively small objects dropped in a wellbore—and particularly metal objects—can often cause the most disruption to downhole equipment and related operations. For example, during completion operations, small pieces of metal present in a wellbore can prevent packers and other completion tools from sealing against a casing wall. During open hole drilling operations, such small metal objects can destroy very expensive downhole equipment such as Polycrystalline Diamond Compact (PDC) bits.

Such small objects can also be very difficult to retrieve from a wellbore, as they are often too small to be grasped using conventional fishing tools. This is especially true for small metal objects and, in particular, small metal objects that have an irregular shape or small pieces that can be broken up during the retrieval process. Unfortunately, drilling rigs typically have many small metal objects (such as, for example, wrenches, chain, bolts, tong dies and nuts) at or near the rig floor. Such objects, which are in relatively close proximity to the upper opening of a well, are at risk of falling into a wellbore.

As noted above, such relatively small metal objects can cause significant disruptions to downhole operations. Further, fishing operations for small metal objects can be very time consuming and, as a result, very costly. Accordingly, the best way to prevent such disruptions and to avoid long and expensive fishing operations for such small objects is to keep such objects from entering a wellbore in the first place.

Rig operating procedures frequently dictate that when no pipe is present in a wellbore that blind rams in a blowout preventer ("BOP") assembly be closed in order to block access to subterranean portion of said wellbore and keep any unwanted falling objects from entering said wellbore from above the BOP assembly. If an object is dropped into a well at the rig floor, with such BOP blind rams closed, the object will not fall all the way into the subterranean portion of a wellbore. However, this solution is less than optimal, because the object must still be retrieved from the top of the rams before operations can resume. Such retrieval process typically requires draining such BOP assembly of fluids to locate the object, opening the bonnet in the BOP assembly, finding and retrieving the object, and then closing and retesting the BOP assembly to the required test pressures. This retrieval process—while frequently quicker and less expensive than fishing the item from the bottom of the well—is nonetheless still relatively expensive, time consuming and dangerous for personnel.

Thus, there is a need for an apparatus and method for catching dropped objects, and particularly metallic objects, before such objects enter the subterranean portion of a well. Such apparatus and method should prevent dropped objects from falling further into a wellbore, and should hold such objects for ultimate retrieval and removal from a wellbore. As an added benefit, such apparatus should also allow for the removal of metallic debris from well fluids. Such apparatus can be disposed at virtually any location(s) between a rig floor of a drilling or completion rig, and a wellhead assembly of a well. In many cases, said apparatus can be conveniently and effectively situated at or in proximity with a bell nipple assembly, or as part of a riser assembly on a floating drilling rig.

SUMMARY OF THE PRESENT INVENTION

The present invention comprises an apparatus for generating a magnetic field that can be attached to, placed in the vicinity of, or made a part of a wellbore. The magnetic field is used to catch falling metal and/or magnetic objects from passing beyond a wellhead and entering the subterranean portions of a wellbore. Said magnetic field can also catch ferrous metallic and/or other magnetic objects and debris present in well fluids, and permit easy and efficient removal thereof.

A magnet assembly of the present invention comprises at least one magnet and is disposed on, around, or as an integral part of a wellbore. The magnet(s) of the magnet assembly of the present invention can be sized based on the internal diameter of a wellbore, as well as the ability to catch certain representative objects that have been dropped into or fished out of wellbores.

In the preferred embodiment, the magnet assembly of the present invention can be mounted at or near the bell nipple. Typically, the magnet assembly of the present invention can be installed between the upper surface of a BOP assembly and the lower portion of a bell nipple assembly. However, it is to be observed that such magnet assembly can be placed in other areas such as, for example, within a riser assembly situated between a subsea wellhead and a floating drilling vessel.

The magnets of the present invention are removably mounted and can be selectively moved away from a wellbore when desired. For example, it may be beneficial to selectively move said magnets away from said wellbore to prevent magnetic interference with logging tools or other equipment that may be sensitive to magnetic fields, or when circulating large concentrations of metallic debris in a rig fluid system (such as, for example, when milling up stuck metal objects in a well). Movement of said magnets can be manually performed, or remotely actuated using pneumatic or hydraulic powered assemblies.

In the preferred embodiment, the magnet assembly of the present invention comprises a central housing member defining an internal chamber, as well as an inlet and outlet in communication with said internal chamber. Hinged and recessed hatch doors allow selective access into said internal chamber. Hinged magnet members, which can be partially received within recesses formed in said hatch doors, are mounted in proximity to said hinged hatch doors. Further, said hinged magnet members and hatch doors can be selectively positioned relative to one another.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 1:
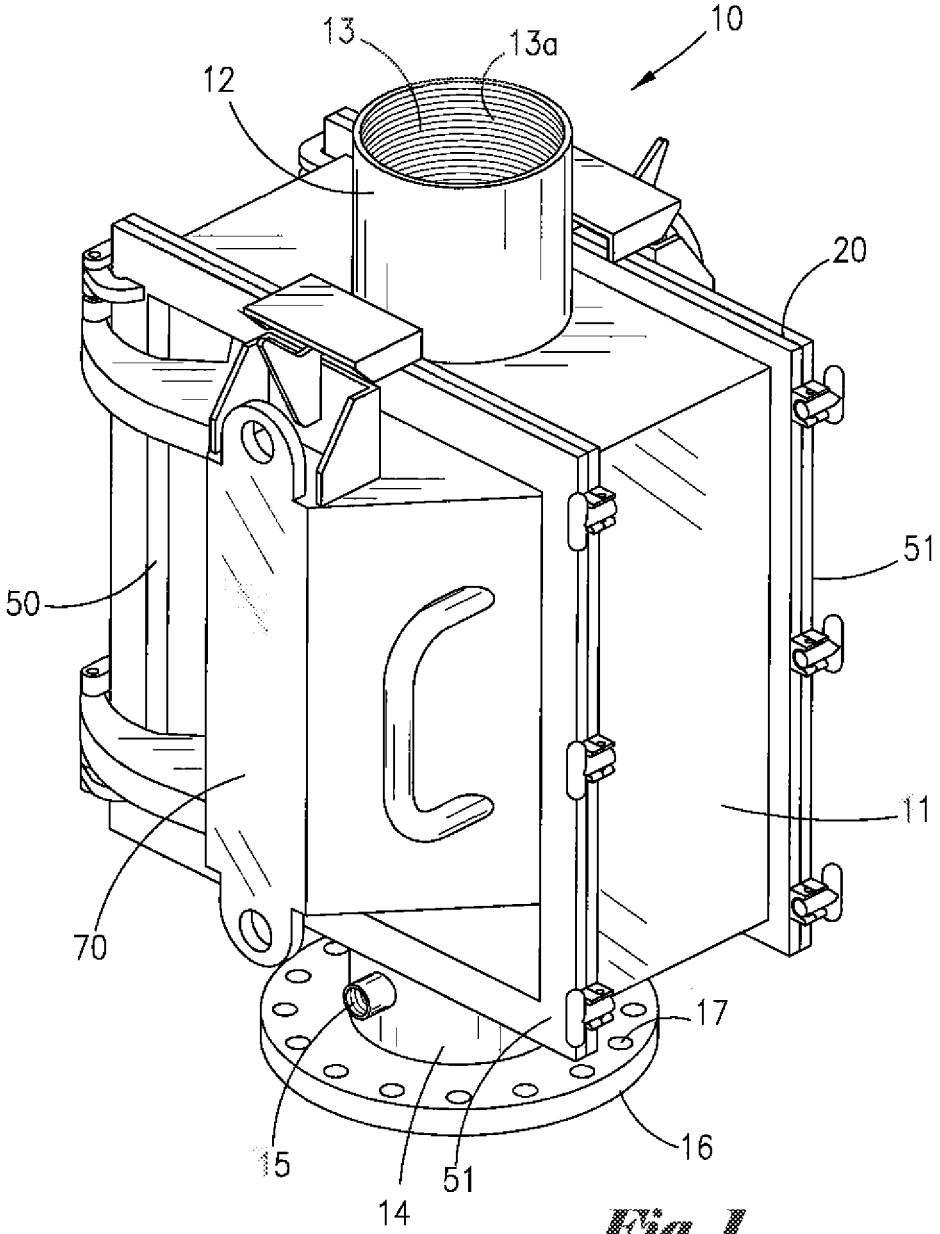
FIG. 1 depicts a side perspective view of a magnet assembly of the present invention in a closed position.

Referring to the drawings, FIG. 1 depicts a side perspective view of a magnet assembly 10 of the present invention in a closed position. Generally, said magnet assembly 10 of the present invention can be installed in relatively close proximity to the upper opening of a wellbore (such as, for example, near a bell nipple assembly). Said magnet assembly 10 generates a magnetic field that is beneficially directed inwardly toward said wellbore to in order to catch falling magnetic (such as, for example, metallic) objects and prevent such objects from entering a subterranean portion of said wellbore, as more fully described herein.

Still referring to FIG. 1, magnet assembly 10 comprises central housing member 11. As depicted in FIG. 1, said central housing 11 comprises a substantially hollow, box-shaped enclosure having an internal chamber that defines an inner volume. However, it is to be observed that central housing 11 can exhibit any number of different shapes or configurations while remaining functional and without departing from the scope of the present invention as set forth herein.

Upper tubular extension 12 extends from the upper surface of central housing member 11, while lower tubular extension 14 extends from the bottom surface of said central housing member 11. Said upper tubular extension 12 and lower tubular extension 14 are axially aligned with one another, and both open into and are in communication with the inner chamber of central housing member 11.

In the preferred embodiment depicted in FIG. 1, said upper tubular extension 12 has a central through bore defining an inner surface 13 having internal threads 13*a*. Lower tubular extension 14 has a central through bore (not depicted in FIG. 1), drain port 15 and lower base connection flange 16 having bolt holes 17. The central bores of upper tubular extension 12 and lower tubular extension 14 are in substantial axial alignment and fluid communication with the internal chamber of central housing member 11.

Although said magnet assembly 10 can be installed within a wellbore in many different configurations, in the preferred embodiment said magnet assembly 10 can be installed immediately above a BOP assembly with said base connection flange 16 mating with the upper connection flange of said BOP assembly (typically the uppermost connection flange of an annular blowout preventer). A bell nipple can connect to upper extension member 12. In this manner, said magnet assembly 10 can be installed "in-line" between said BOP assembly and said bell nipple assembly.

Figure 2:
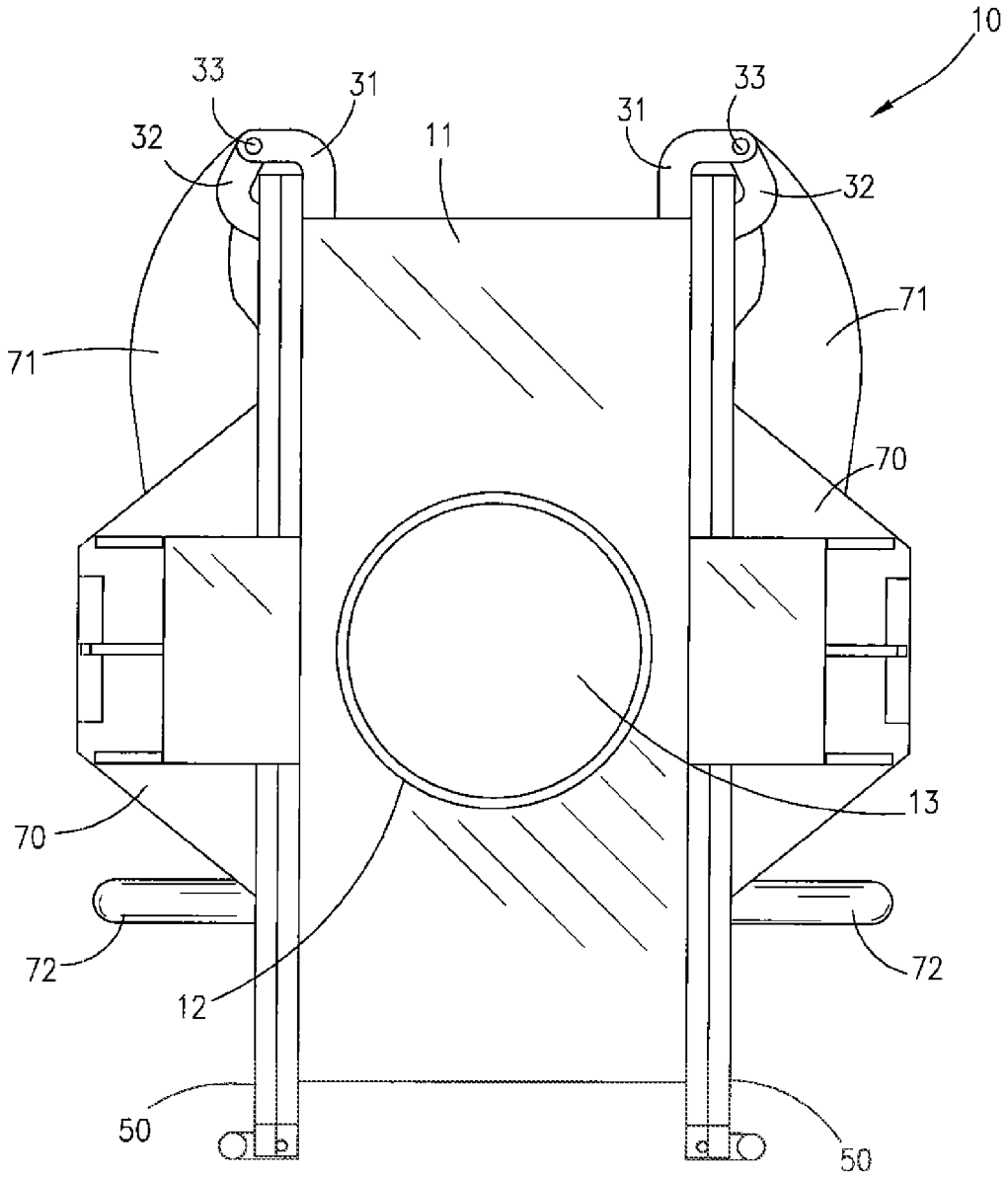
FIG. 2 depicts an overhead view of a magnet assembly of the present invention in a closed position.

FIG. 2 depicts an overhead view of magnet assembly 10 of the present invention in a closed position. Central housing 11 comprises a substantially hollow box-shaped enclosure defining an internal chamber having a volume. Upper tubular extension 12 extends from the upper surface of central housing member 11; said upper tubular extension 12 has a central through bore defining an inner surface 13.

It is to be observed that an unobstructed bore and flow path is formed through magnet assembly 10. Specifically, said bore and flow path extends through upper tubular extension 12, central housing member 11 and lower tubular extension 14 (not shown in FIG. 2). As such, when said magnet assembly 10 is installed "in-line" within a wellbore (such as, for example, between a BOP assembly and bell nipple assembly, or in the riser assembly of a floating drilling vessel), an unobstructed passage way and a direct flow path exists through said magnet assembly 10.

Still referring to FIG. 2, hatch door members 50 are connected to central housing member 11 using hinge assemblies. Specifically, each hinge assembly comprises a housing hinge member 31 pivotally connected to hatch door hinge member 32 using hinge pin 33. Said hinge assemblies permit each such hatch door members 50 to open or swing outward relative to housing member 11 about an axis passing through said hinge pin 33. When said hatch doors 50 are open, access is permitted into the inner chamber of central housing 11; said hatch doors 50 essentially act as so-called "stripper doors" that allow access into the inner chamber of housing 11.

Referring back to FIG. 1, said hatch door members 50 are both in a closed position. Each hatch member 50 has outer hatch plate 51 having substantially flat surfaces, which contacts and engages against substantially flat surfaces of hatch frame 20. Said hatch members 50 can be selectively secured in a closed configuration, or unsecured as discussed in detail herein. In the configuration depicted in FIG. 1, magnet members 70 are partially received within recesses formed by hatch doors 50.

Referring to FIG. 2, magnet members 70 are also hingedly attached to central housing member 11. Specifically, magnet hinge member 71 of each magnet member 70 is pivotally connected to housing hinge member 31 using hinge pin 33. Said hinge assemblies permit said magnet members 70 to swing outward relative to housing member 11 and/or hatch doors 50, about an axis passing through said hinge pin 33. It is also to be observed that said magnet members 70 and hatch doors 50 can independently pivot or hinge about an axis passing through said hinge pin 33. Handles 71 are provided on magnet members 70 to facilitate gripping and moving of said magnet members 70. It is also to be observed that magnet members can also be hingedly connected to hatch door members 50 without departing from the scope of the present invention.

Figure 3:
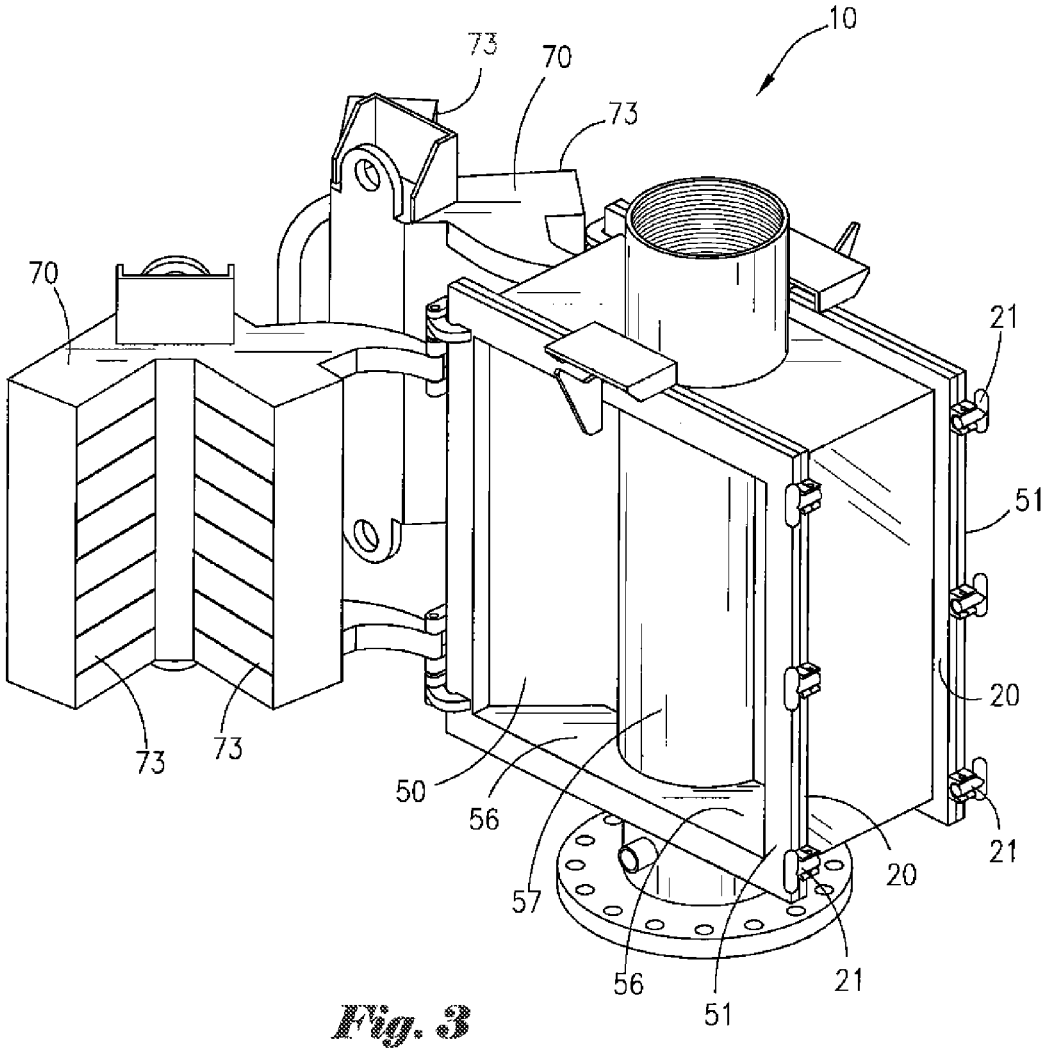
FIG. 3 depicts a side perspective view of a magnet assembly of the present invention with the magnet members in an open position.

FIG. 3 depicts a side perspective view of magnet assembly 10 of the present invention with hatch doors 50 secured and locked in a closed position, and magnet members 70 in an open or extended position. Said hatch doors 50 are closed and secured in place relative to housing 11 using locking clamp members 21, while magnet members 70 are pivotally extended (that is, swung open) relative to said hatch doors 50 and housing 11. When in the closed and secured position, hatch doors 50 can form a fluid pressure seal with housing 11 of magnet assembly 10. It is to be observed that gasket members or elastomeric sealing members may be disposed between outer hatch plate 51 and hatch frame 20 to further facilitate a fluid pressure seal when hatch doors 50 are secured in a closed-position.

In the preferred embodiment of the present invention, said magnet members 70 comprise rare earth or ceramic magnet segments 73 exhibiting desired magnetic characteristics (that is, creating their own persistent magnetic fields). Further, in the preferred embodiment, each of said magnet members 70 has magnet segments 73 oriented in a V-shaped configuration, which helps to focus the magnetic field(s) generated by said magnet members 70.

Still referring to FIG. 3, in the preferred embodiment, hatch door members 50 each have an outer surface that beneficially defines substantially parallel recessed areas 56 that are disposed on both sides of central convex semi-cylindrical member 57. Said hatch door members 50 and magnet members 70 can open and close independently of each other. As such, it is to be observed that, when said magnet members 70 and hatch doors 50 are joined together, said V-shaped magnet segments 73 of magnet members 70 are partially received within recessed areas 56 defined by said hatch doors 50. In this position, said magnet segments 73 of said magnet members 70 are partially subsumed within said hatch doors 50.

Figure 4:
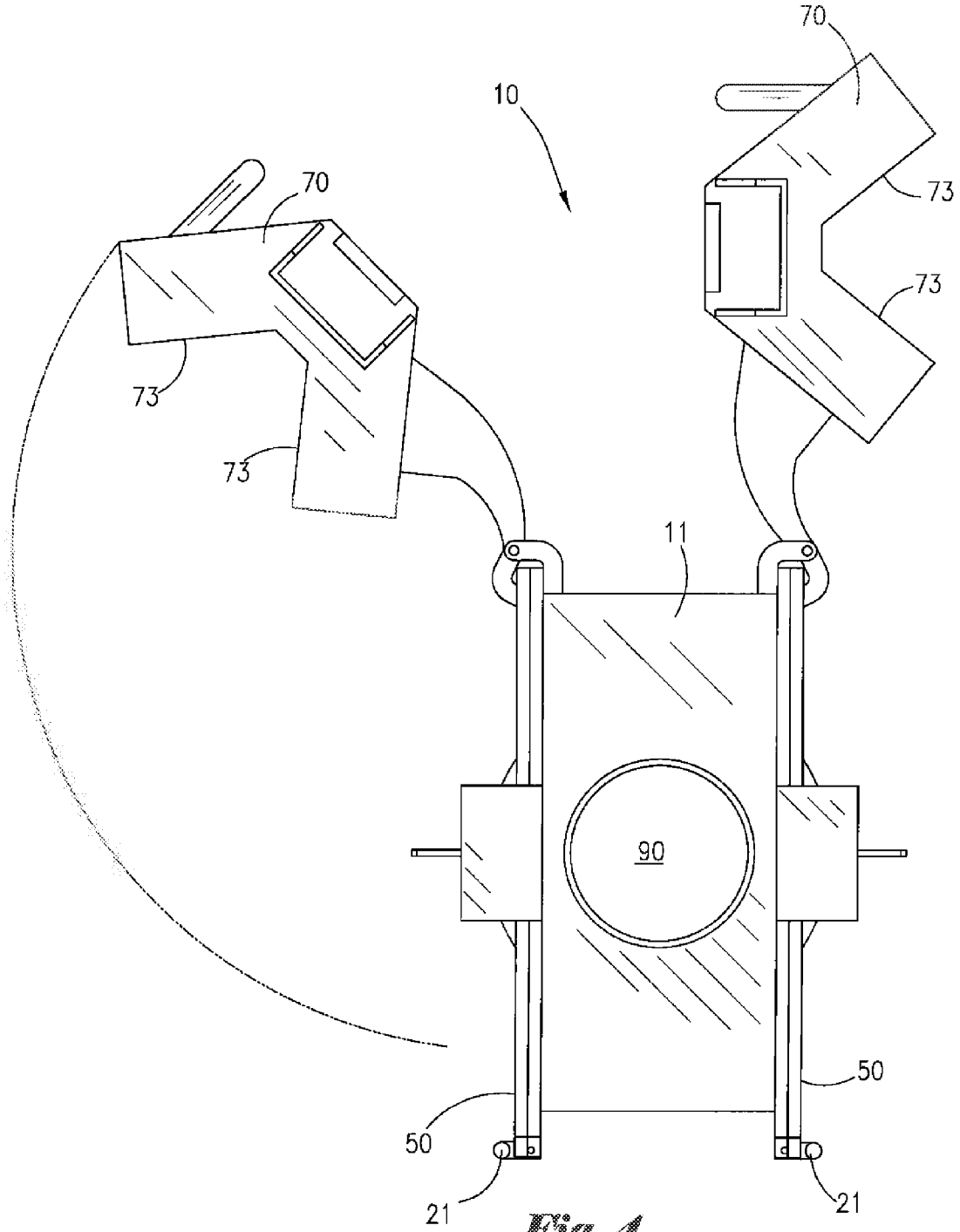
FIG. 4 depicts an overhead view of a magnet assembly of the present invention with the magnet members in an open position.

FIG. 4 depicts an overhead view of a magnet assembly 10 of the present invention with magnet members 70 in an open or extended position. Hatch doors 50 are closed and secured in place relative to housing 11 using locking clamp members 21. Magnet members 70 comprised of V-shaped magnet segments 73 are pivotally extended or swung open relative to said hatch doors 50 and housing 11.

As depicted in FIG. 4, magnet members 70 of said magnet assembly 10 can be selectively opened away from the central axial through-bore 90 formed through magnet assembly 10 when desired. For example, it may be beneficial to selectively move said magnets members 70 away from central axial through-bore 90 formed through magnet assembly 10 to prevent magnetic interference with logging tools or other equipment that may be sensitive to magnetic fields, or when circulating large concentrations of metallic debris in a rig mud system (such as, for example, when milling up stuck metal objects in a well). It is to be observed that said assembly for repositioning said magnets can be manually operated (as depicted herein), or remotely actuated using pneumatic or hydraulic powered means well known to those having skill in the art.

Figure 5:
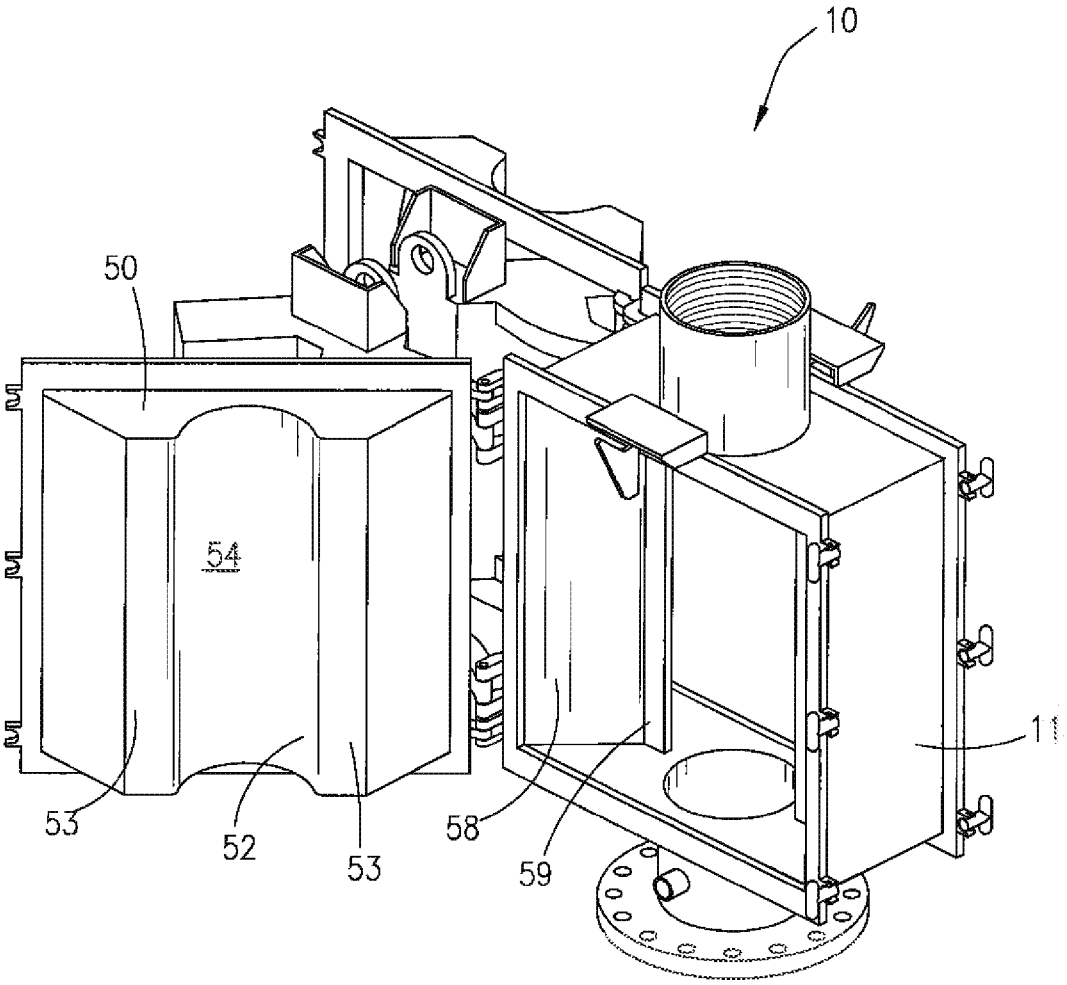
FIG. 5 depicts a side perspective view of a magnet assembly of the present invention with the hatch door members in an open position.

FIG. 5 depicts a side perspective view of magnet assembly 10 of the present invention with hatch door members 50 in an open position. As depicted in FIG. 5, in the preferred embodiment, said hatch door members 50 can be selectively opened to provide access to the internal chamber within central housing 11. Internal surface 52 of each hatch door 50 defines substantially parallel wedge-shaped members 53, Said wedge-shaped members 53 are oriented substantially vertically, while a concave semi-cylindrical recess 54 is disposed between said wedge-shaped members 53. Lateral wedge-shaped stand-off members 58 having end strip 59 are disposed within inner chamber of central housing 11.

Figure 6:
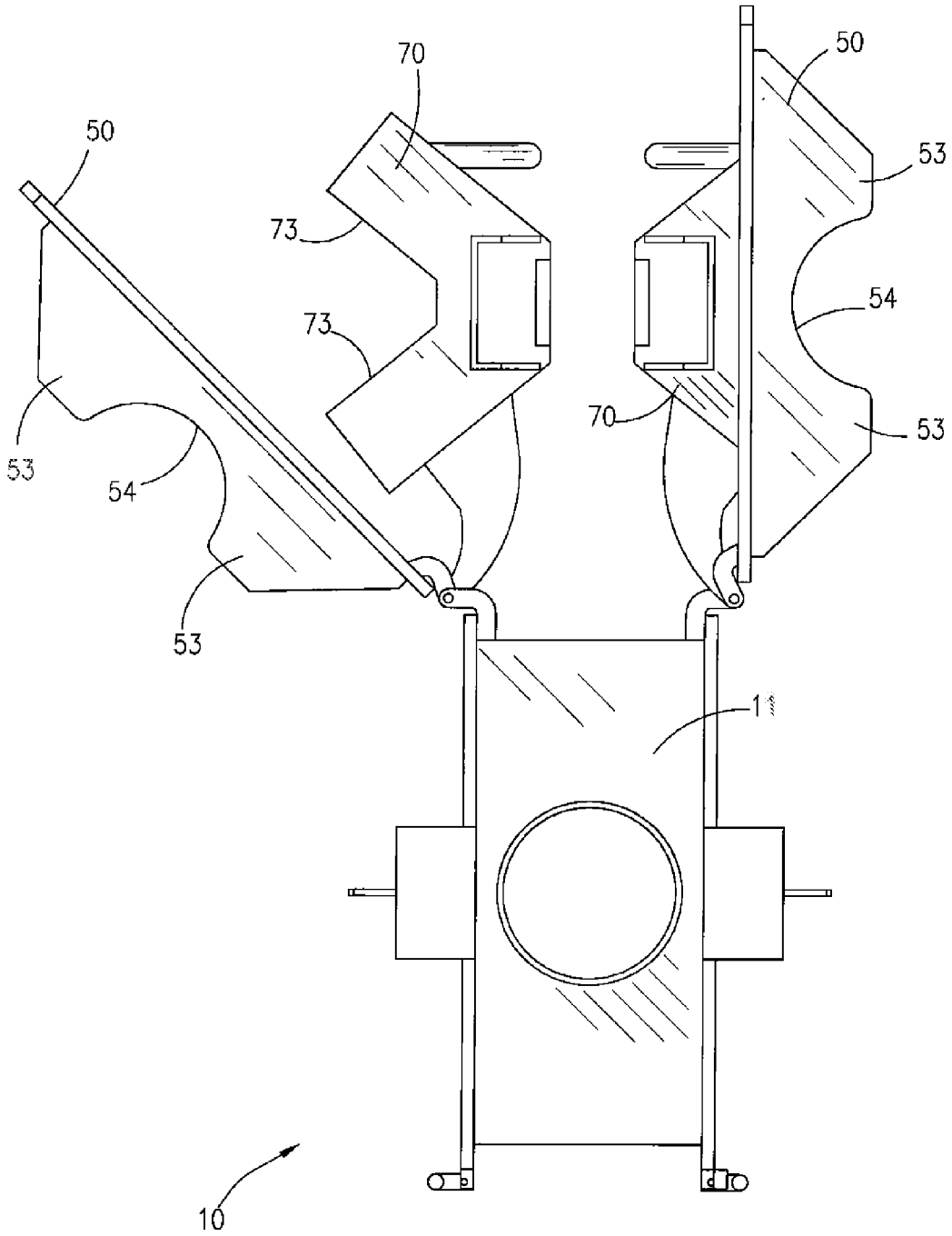
FIG. 6 depicts an overhead view of a magnet assembly of the present invention with the magnet members and hatch doors in an open position.

FIG. 6 depicts an overhead view of magnet assembly 10 of the present invention with magnet members 70 and hatch doors 50 in an open position. Said hatch door members 50 can be selectively opened to provide access to an internal chamber within central housing 11. Each hatch door 50 includes substantially parallel internal wedge-shaped members 53 and concave semi-cylindrical recess 54.

Figure 7:
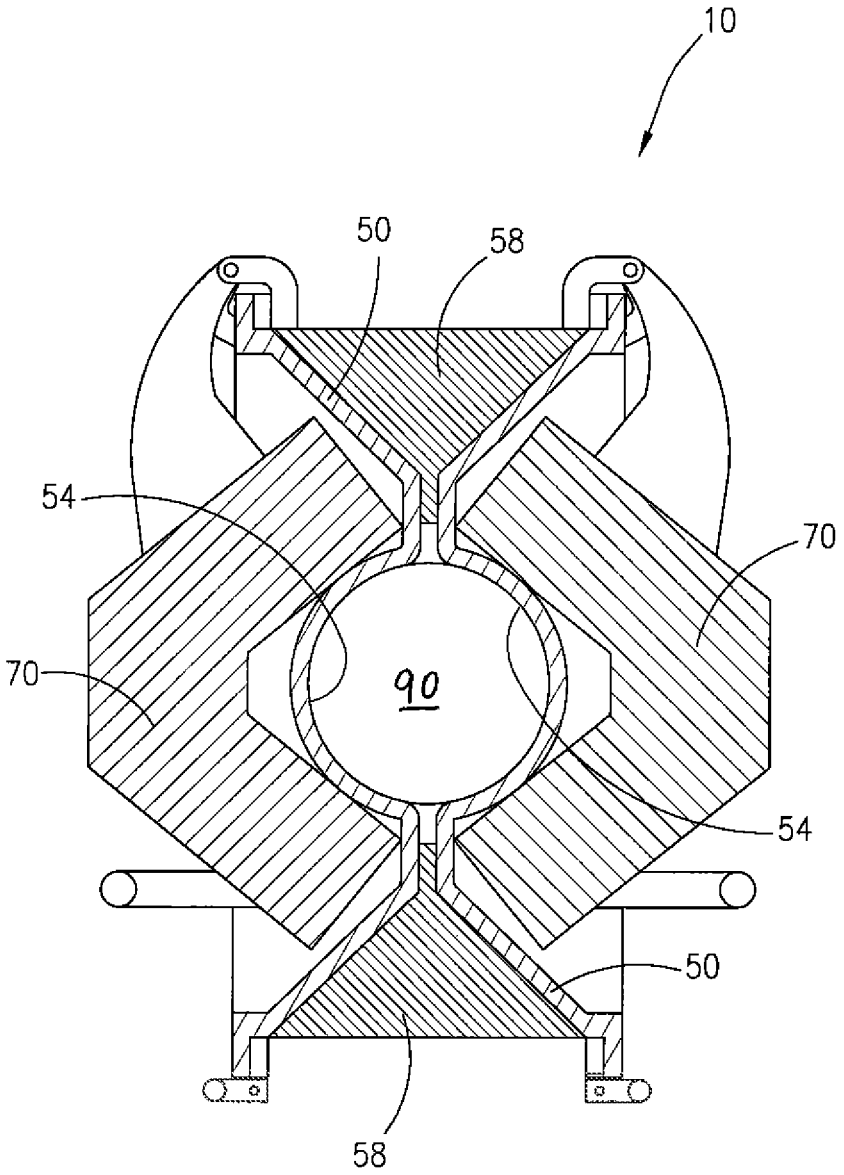
FIG. 7 depicts an overhead sectional view of the magnet assembly of the present invention.

FIG. 7 depicts an overhead sectional view of magnet assembly 10 of the present invention. Referring to FIG. 7, when both of said hatch doors 50 are closed, it is to be observed that semi-cylindrical concave recesses 54 of said opposing hatch doors 50, as well as lateral wedge-shaped stand-off members 58, cooperate to form a substantially cylindrical through-bore 90 extending vertically through said central housing member 11. In this manner, an unobstructed path is formed through magnet assembly 10—that is, an obstructed bore extends through magnet assembly 10 via aligned upper tubular extension 12, central housing member 11 and lower tubular extension 14, as depicted in FIG. 1, for the passage of tools or equipment, as well as the flow of fluid.

Still referring to FIG. 7, said hatch door members 50 and magnet members 70 can open and close independently of each other. As such, it is to be observed that, when said magnet members 70 and hatch doors 50 are joined together, said V-shaped magnet members 70 are partially received within recessed areas defined by said hatch doors 50. In this position, said magnet members 70 are partially subsumed within said hatch doors 50, and are beneficially positioned proximate to said central through-bore 90.

Figure 8:
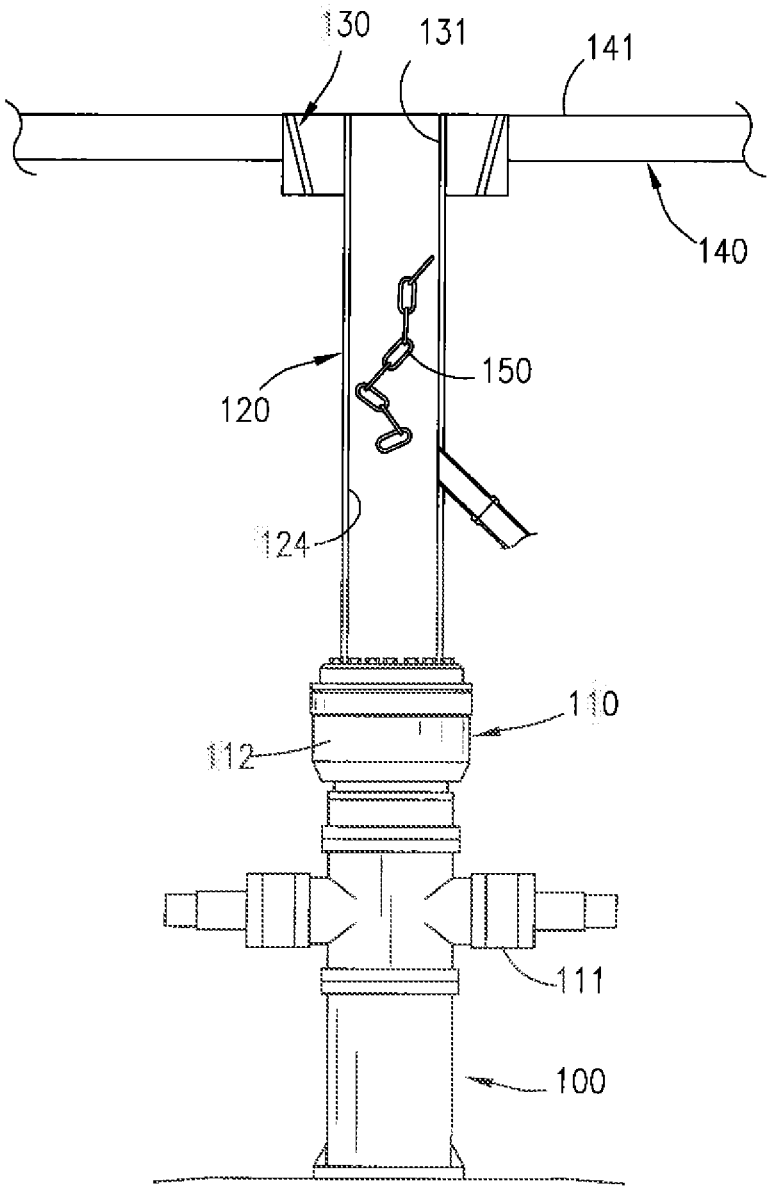
FIG. 8 depicts a side sectional view of a conventional wellbore configuration having a ball nipple assembly, BOP assembly and well head assembly.

FIG. 8 depicts a side sectional view of a conventional wellbore configuration on a drilling rig. As depicted in FIG. 8, bell nipple 120 is connected at its upper end to rotary assembly 130, and at its lower end to blowout preventer ("BOP") assembly 110. Rotary assembly 130 is mounted at rig floor 140 having upper surface 141, and defining an upper opening 131. BOP assembly 110 is connected to wellhead 100 which is mounted to the upper portion of a wellbore (not shown in FIG. 3) extending into the earth's crust. BOP assembly 110 generally comprises ram assembly 111 and annular preventer assembly 112.

Bell nipple assembly 120 acts as a "funnel" to guide drilling tools into and out of the upper opening of a wellbore. Unfortunately, not all objects that a bell nipple guides into a wellbore are beneficial, such as chain segment 150 that is depicted falling in central through-bore 124 of bell nipple assembly 120. If falling objects such as chain segment 150 are not stopped before entering the subterranean portion of a wellbore, such objects can prevent downhole equipment from functioning properly and can often negatively impede the drilling process as detailed herein.

Figure 9:
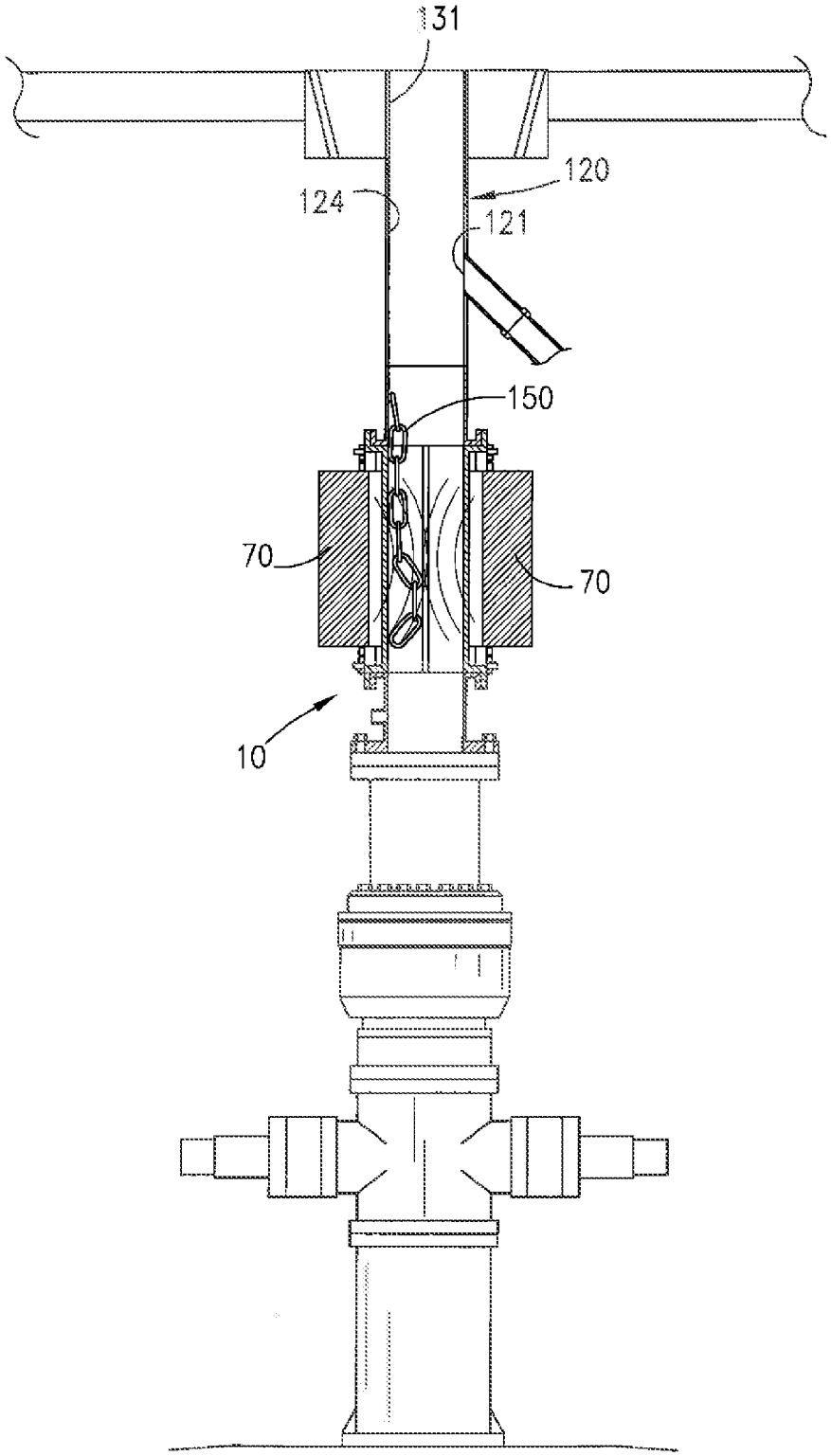
FIG. 9 depicts a side sectional view of a wellbore equipped with a magnet assembly of the present invention.

FIG. 9 depicts a side sectional view of a wellbore equipped with the magnet assembly 10 of the present invention. Magnet assembly 10 of the present invention, and more particularly magnet members 70 thereof, create an inwardly directed magnetic field. In the preferred embodiment, said magnetic field is generally focused or directed toward central through-bore of said magnet assembly, which is in alignment with said wellbore. As a result, metal objects dropped into the upper opening 131 of a well, such as chain segments 150, are caught in said magnetic field 21; accordingly, such metal objects do not pass magnet assembly 10, and do not enter the subterranean portions of a wellbore. Such objects (such as, for example, chain segments 150) can be easily retrieved from magnet assembly 10.

It is to be observed that the magnet assembly 10 of the present invention can be disposed at virtually any position along the distance that exists between: (1) a rig floor of a drilling or completion rig; and (2) a wellhead of a well being serviced by said drilling or completion rig. For example, it is possible that said magnet assembly of the present invention and related method could be incorporated directly within a BOP assembly or wellhead assembly. Additionally, when installed in connection with a floating drilling vessel, it is to be observed that magnet assembly 10 of the present invention can be installed as part of the riser that extends from a rig to a subsea BOP assembly. However, without limiting the scope of the present invention in any manner, the simplest and most effective manner of implementing the present invention will frequently involve installing the magnet assembly of the present invention between a BOP assembly and a bell nipple assembly as described herein.

Said magnet assembly 10 can be beneficially situated above or below the side outlet of said bell nipple; however, as depicted herein, when said magnet assembly 10 is installed between a bell nipple assembly and BOP assembly, said magnet assembly 10 will be situated below said fluid outlet part. Because any liquid in central through-bore 124 of bell nipple assembly 120 drains through said side outlet port 121, the liquid level within said through-bore 124 does not extend above said outlet port 121. Accordingly, magnet assembly 10 can be positioned below said outlet port 121 of bell nipple assembly 120. In such an installation, the magnetic field generated by magnet assembly 10 extends into a "wet" portion of bell nipple assembly 120 (that is, a portion of bell nipple central through-bore 124 that contains drilling mud or other liquid).

Figure 10:
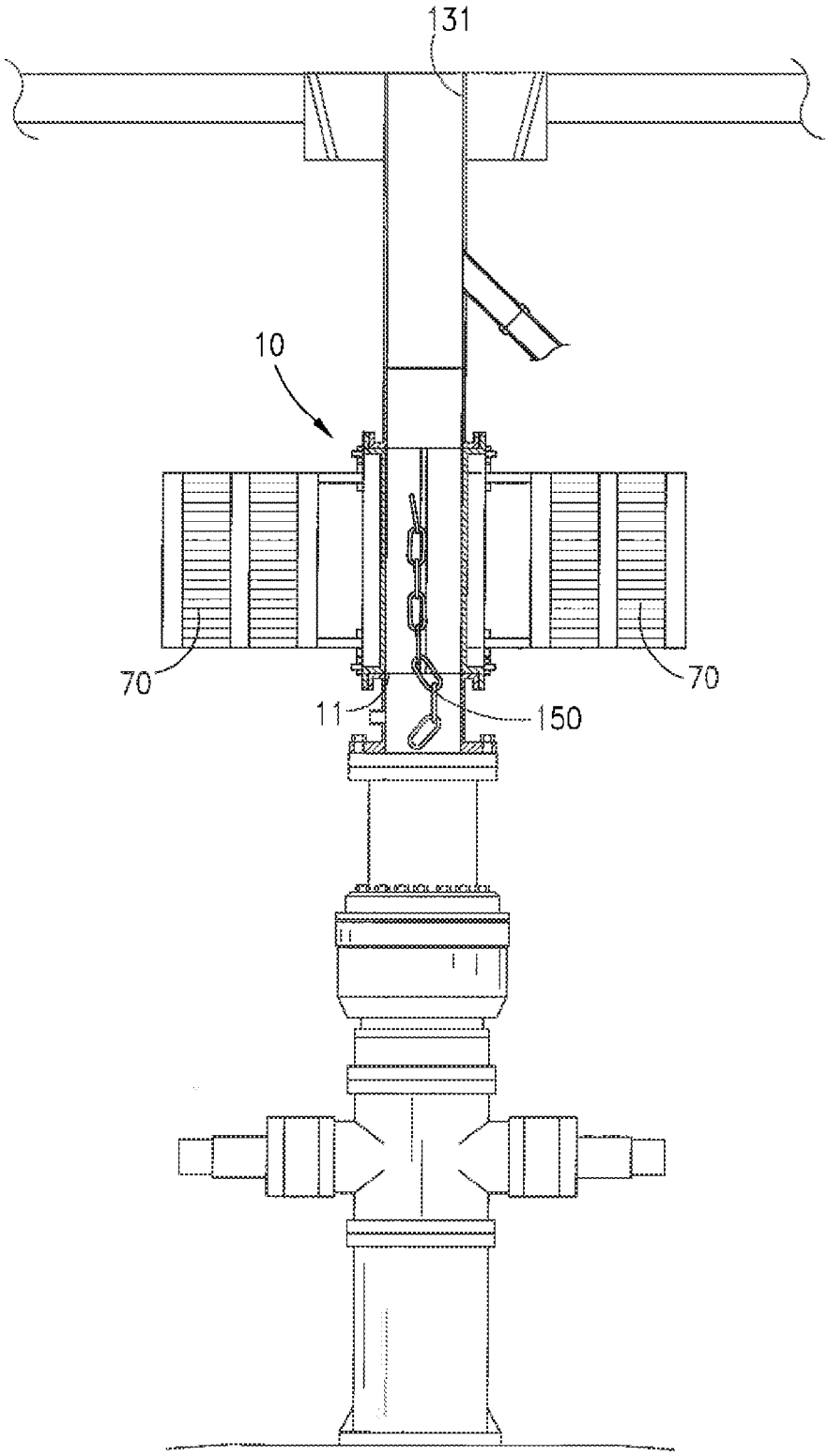
FIG. 10 depicts an alternate side sectional view of a wellbore equipped with a magnet assembly of the present invention.

FIG. 10 depicts an alternate side sectional view of a wellbore equipped with magnet assembly 10 of the present invention. As depicted in FIG. 10, magnet members 70 of said magnet assembly 10 are shown in the extended or open position. In this position, the magnetic field generated by said magnet members 70 is not directed toward the inner chamber of central housing 11 of magnet assembly 10. As such, metallic chain segments located within said magnet assembly 10 are not caught within said magnetic field, and would be able to pass by magnet assembly 10 when falling from upper opening 131.

As noted above, in certain circumstances, it may be beneficial to selectively position said magnets members 70 temporarily away from central housing 11 of magnet assembly 10 in order to prevent magnetic interference with logging tools or other equipment that may be run into a well equipped with magnet assembly 10. Similarly, it may also be beneficial to selectively position said magnets members 70 temporarily away from central housing 11 when circulating large concentrations of metallic debris in a rig mud system (such as, for example, when milling up stuck metal objects in a well) in order to prevent clogging of magnet assembly 10. Notwithstanding the foregoing, in other circumstances, it may be beneficial to remove metallic particles or debris from wellbore fluids using magnet assembly 10.

Figure 11:
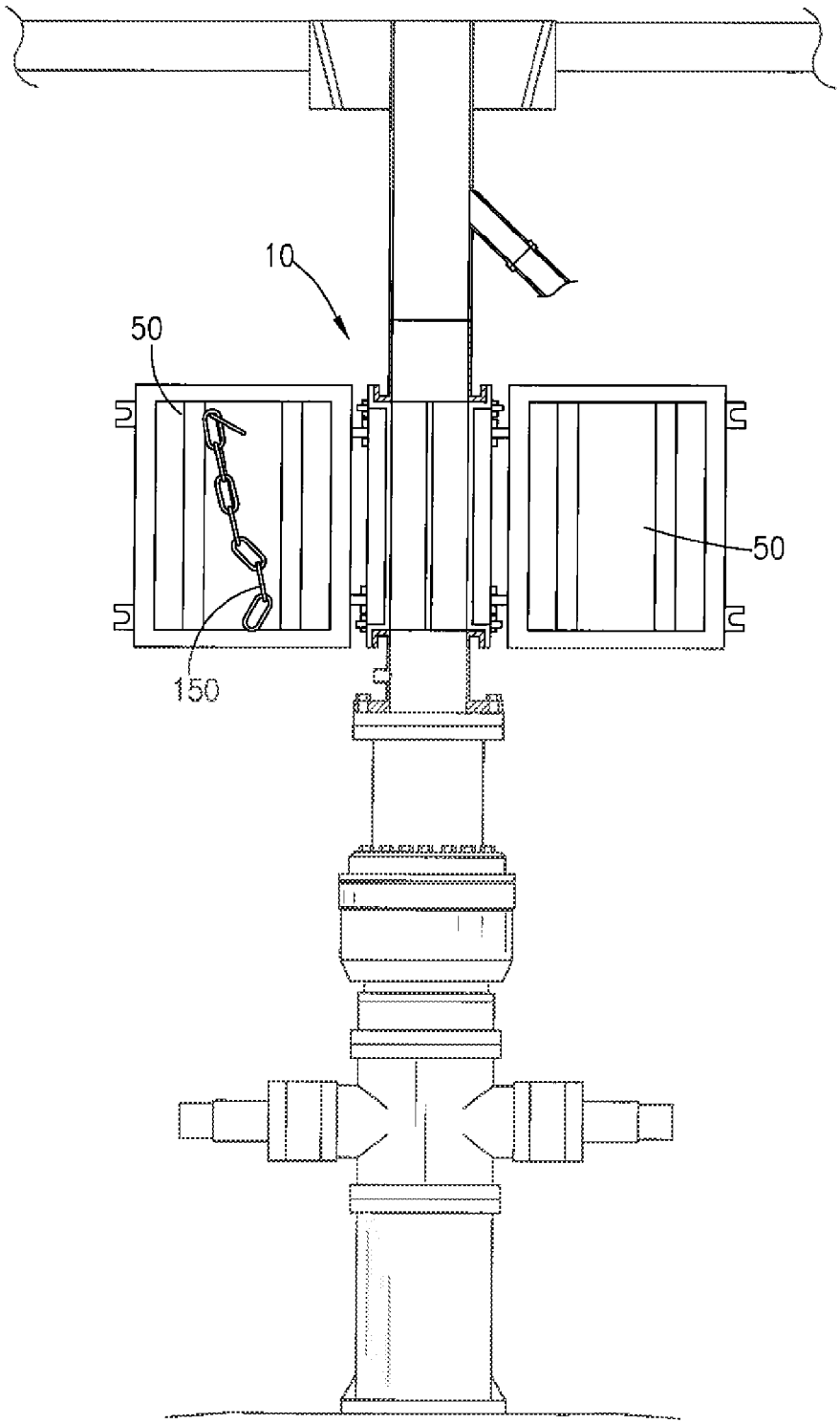
FIG. 11 depicts an alternate side sectional view of a wellbore equipped with a magnet assembly of the present invention.

FIG. 11 depicts an alternate side sectional view of a wellbore equipped with magnet assembly 10 of the present invention. As depicted in FIG. 11, hatch doors 50 (including attached magnet members 70) of said magnet assembly 10 are shown in the extended or open position. In this position, said open hatch doors 50 permit access into the inner chamber of central housing member 11 (and, thus, the wellbore). Because magnet members 70 remain in close proximity to said hatch doors 50, the magnetic field generated by said magnet members 70 is directed through said open hatch doors 50. As such, metallic chain segments 150 located within said wellbore are caught within said magnetic field even with said hatch doors 50 open, and can be removed from the inner surface of said open hatch doors 50.

In operation, magnet assembly 10 of the present invention can be used to quickly and efficiently capture certain objects dropped in a well. When such an object is dropped into a well, the BOP assembly can be closed as a "fail-safe" to prevent access into a wellhead and the upper portion of a wellbore. Thereafter, any drilling mud or other fluid can be drained from inside said magnet assembly 10 via drain port 15. One hatch door 50, with an applicable magnet member 70 (or, more particularly, magnet segments 73 thereof) still partially received within said hatch door, can be opened completely to provide access into the inner chamber of central housing 11. (In most instances, both hatch doors 50 are not opened simultaneously in order to prevent possible loss of magnetic forces on a caught object, particularly if such object spans substantially across the width of magnet assembly 10). Once the object is removed, hatch door(s) 50 can be closed and locked in place. Thereafter, the BOP assembly can be opened, and drilling or other operations can be resumed.

In many cases, milling of downhole equipment or other wellbore operations can generate metallic shavings, particles or other debris supported in drilling mud or other fluid within a wellbore. Although efforts are made on virtually all rigs to remove debris and contaminants from drilling mud or other fluids, over time such metallic shavings, particles and/or debris can reach significant concentrations in such drilling mud or other fluids. Such metallic content can adversely affect fluid properties, equipment performance and/or operational effectiveness. Thus, it is generally beneficial to remove such metallic materials from such drilling muds or other fluids.

Although magnet assembly 10 of the present invention can be used to catch falling objects, said magnet assembly 10 can also serve the function of catching undesirable metallic materials from drilling mud or other fluid. Such metallic material materials can often attach to the internal surface of hatch doors 50. Moreover, any such metallic material can be recovered and measured, which can frequently provide valuable insight into ongoing operations within a well.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A magnet assembly disposed above a blowout preventer for catching objects falling into a well comprising:

a) a housing having a top, a bottom, a first side, a second side, a front having an opening, a back having an opening, and an internal chamber, wherein said internal chamber is aligned with said wellbore;

b) a first door removably covering said opening in said front, wherein said first door is adapted to alternate between a first open position and a second closed position;

c) a second door removably covering said opening in said back, wherein said second door is adapted to alternate between a first open position and a second closed position, and wherein a substantially unobstructed path extends through said internal chamber when said first and second doors are in said closed positions;

d) a first magnet movably disposed on said first door; and e) a second magnet movably disposed on said second door.

2. The magnet assembly of claim 1, further comprising a tubular member having a central through bore connected to said top of said housing, wherein said central through bore extends into said internal chamber of said housing.

3. The magnet assembly of claim 1, further comprising a tubular member having a central through bore connected to said bottom of said housing, wherein said central through bore extends into said internal chamber of said housing.

4. The magnet assembly of claim 1, wherein said first and second doors are hingedly connected to said housing.

5. The magnet assembly of claim 1, wherein said first magnet is hingedly connected to said housing or said first door, and said first magnet is adapted to alternate between a first position adjacent to said internal chamber, and a second position away from said internal chamber.

6. The magnet assembly of claim 1, wherein said second magnet is hingedly connected to said housing or said second door, and said second magnet is adapted to alternate between a first position adjacent to said internal chamber, and a second position away from said internal chamber.

7. The magnet assembly of claim 4, wherein said first door has a first side and a second side, and said first side defines a recessed profile.

8. The magnet assembly of claim 7, wherein said first magnet can be partially received within said recessed profile of said first door when said first magnet is in said first position.

9. The magnet assembly of claim 7, wherein said second door has a first side and a second side, and said first side defines a recessed profile.

10. The magnet assembly of claim 9, wherein said second magnet can be partially received within said recessed profile of said second door when said second magnet is in said first position.

11. A magnet assembly disposed above a blowout preventer for catching objects falling into a well comprising:

a) a housing member defining an inner chamber;

b) an inlet to said inner chamber;

c) an outlet from said inner chamber;

d) at least one hatchway leading to said inner chamber;

e) at least one hatch door removably secured over said at least one hatchway, wherein said hatch door is adapted to alternate between a first open position and a second closed position, and wherein a substantially unobstructed path extends through said inner chamber when said hatch door is in said closed position; and f) at least one magnet moveably disposed on said at least one hatch door.

12. The magnet assembly of claim 11, wherein said at least one hatch door is hingedly connected to said housing.

13. The magnet assembly of claim 11, wherein said at least magnet is hingedly connected to said housing or said at least one hatch door, and said magnet is adapted to alternate between a first position adjacent to said inner chamber, and a second position away from said inner chamber.

14. The magnet assembly of claim 11, wherein said at least one hatch door has a first side and a second side, and said first side defines a recessed profile.

15. The magnet assembly of claim 14, wherein said magnet can be partially received within said recessed profile of said at least one hatch door when said magnet is in said first position.

* * * * *